US005121139A

United States Patent [19]

Burke

[11] Patent Number: 5,121,139

[45] Date of Patent: Jun. 9, 1992

[54] COMPACT INK JET PRINTER HAVING A DRUM DRIVE MECHANISM

[75] Inventor: Edward F. Burke, Lake Oswego, Oreg.

[73] Assignee: Tektronix, Inc., Beaverton, Oreg.

[21] Appl. No.: 692,841

[22] Filed: Apr. 29, 1991

[51] Int. Cl.[5] ..... G01D 15/24

[52] U.S. Cl. ..... 346/138; 346/25; 346/140 R; 346/134

[58] Field of Search ..... 346/134, 136, 140 R, 346/25, 138, 135.1; 400/636, 126; 355/295

[56] References Cited

U.S. PATENT DOCUMENTS

| | | | |
|---|---|---|---|
| 3,293,059 | 12/1966 | Stowell | 346/153.1 |
| 4,317,138 | 2/1982 | Bryan et al. | 358/291 |
| 4,386,771 | 6/1983 | Lakdawala | 271/82 |
| 4,491,854 | 1/1985 | Habelt et al. | 346/136 |
| 4,528,576 | 7/1985 | Koumura et al. | 346/140 R |
| 4,581,618 | 4/1986 | Watanabe et al. | 346/134 |
| 4,707,704 | 11/1987 | Allen et al. | 346/24 |
| 4,761,664 | 8/1988 | Piatt et al. | 346/134 |
| 4,761,665 | 8/1988 | Piatt et al. | 346/140 R |
| 4,796,035 | 1/1989 | Kawasaki et al. | 346/108 |
| 4,815,870 | 3/1989 | Sparer et al. | 400/120 |
| 4,829,320 | 5/1989 | Une et al. | 346/76 PH |
| 4,843,338 | 6/1989 | Rasmussen et al. | 346/140 R |

*Primary Examiner*—Benjamin R. Fuller
*Assistant Examiner*—Alrick Bobb
*Attorney, Agent, or Firm*—John D. Winkelman; Edward B. Anderson

[57] ABSTRACT

A compact ink jet printer is described utilizing a small drum for carrying a sheet of record medium during the printing operation. In one embodiment, the drum has an exterior surface with a high coefficient of friction with a contact roller retaining the record medium against the drum as the drum is rotated. Printing is accomplished as by jetting ink from an ink jet print head onto the medium while the medium is backed up by a fixed platen. A fusing mechanism may be utilized to flatten ink drops on the printed medium. A drive mechanism for an ink jet printer may include a stepper motor coupled by timing belt sprockets and a timing belt to the drum of the printer. These components may be selected such that the drum is incremented a multiple of a pixel height during each step of the stepper motor. The record medium may also be clamped to a drum by a clamping mechanism and rotated through plural revolutions of the drum during respective printing and fusing steps.

16 Claims, 6 Drawing Sheets

COMPACT INK JET PRINTER HAVING A DRUM DRIVE MECHANISM

TECHNICAL FIELD

The present invention relates to ink jet printers and more particularly to compact ink jet printers and also to a simple, accurate and reliable drive mechanism for printers.

BACKGROUND OF THE INVENTION

Ink jet printers, and in particular, drop-on-demand ink jet printers having print heads with acoustic drivers for ink drop formation, are well known in the art. The principle behind an impulse ink jet of this type is the generation of a pressure wave in an ink chamber and subsequent emission of ink droplets from the ink chamber to a nozzle orifice as a result of the pressure wave. A wide variety of acoustic drivers have been employed in ink jet print heads of this type. For example, such drivers may consist of a transducer formed by piezoceramic material bonded to a thin diaphragm. In response to an applied voltage, the diaphragm displaces ink in the ink chamber and causes a pressure wave and the consequent flow of ink to one or more nozzles. other types of acoustic drivers for generating pressure waves in ink include heater-bubble source drivers (so called bubble jets) and electromagnet solenoid drivers.

Known ink jets typically combine an ink jet print head, from which drops of ink are ejected toward a record medium, with a reservoir for supplying ink, including plural colors of ink, to various nozzles of the ink jet print head. Also, it is common to shuttle or scan an ink jet print head transversely across a record medium as the medium is being printed by the print head.

In a typical application, record media (a sheet of paper, for example) is delivered to a drum and secured to the drum for subsequent printing by a mechanism, such as a clamp, that grips one edge of the medium. As the drum rotates past a printing location, ink is ejected from the print head onto the medium to accomplish the printing. In a typical printing arrangement, the medium is, in effect, printed in rows of pixels, each pixel (picture element) having a predetermined size and height. The height of the pixel corresponds to a distance along the medium in the direction of rotation of the drum.

One exemplary printer is shown in U.S. Pat. No. 4,581,618 Watanabe et al. In Watanabe, record medium is fed by a roller mechanism to a first pinch roller which bears against a drum. This drum is described as being a platen of high friction material, such as rubber. Soft rubber rollers would not have a precise radius, particularly at locations where engaged by other rollers. A motor 10, described as a "feed pulse" motor, is used to drive the drum and the paper transport mechanism of the printer. An elaborate multiple gear drive system is used to couple the motor to the drum and other paper transport rollers of the system. At the appropriate time, the medium is transferred from the first roller to the drum, with the medium being retained on the drum by a movable pinch roller illustrated in this patent as having a gap in its center. The movable pinch roller retains the paper on the drum by torque established by a friction clutch. During printing, the drive mechanism is described as rotating the drum through a predetermined angle after the printing of each line of print.

Because gears are used in the paper transport mechanism of this device, backlash can occur which can result in inaccurate positioning of the paper during the printing operation. Also since gears typically have very few teeth which engage one another at any given time, variations in the configuration of particular teeth of a gear translate to inaccuracies in the transportation of the record medium through the printer. In addition, a drive mechanism that relies on a multiplicity of gears is subject to wear and mechanical failure.

U.S. Pat. No. 4,707,704 to Allen et al. mentions the use of a stepper motor for driving a drum of an ink jet printer. In this patent, the stepper motor is shown coupled directly to the shaft of the drum. With this construction, the inertia of the drum is applied directly to the motor shaft and can cause a very poor inertia match between the motor and the load on the motor. In addition, this patent discloses a transport path in which a roll of record media is positioned within a drum and moved by an internal roller, including one covered with resilient material, to the exterior of the drum for printing.

Prior art printers have also employed numerous types of clamps for securing record media to a drum during printing operations. U.S. Pat. No. 4,815,870 to Sparer et al. discloses a sheet clamp for a thermal printer drum in which the clamp is positioned within a recess of the drum. The drum is rotated in one direction during printing and in a reverse direction during sheet ejection.

Still another clamping device is shown in U.S. Pat. No. 4,386,771 Lakdawala for a facsimile machine. In this device, a gripping bar grips the edge of a sheet to hold it onto a drum. The direction of rotation of the drum is reversed to eject the sheet from the drum with a guide and a sheet scraper being utilized to remove the sheet from the device.

The use of pressure fixing rollers for fusing or spreading phase-change or hot-melt ink on record media is also known. Japanese Patent No. 18,351 to Moriguchi et al., U.S. Pat. No. 4,745,420 to Gerstenmeier and U.S. Pat. No. 4,889,761 to Titterington et al. are examples. Other examples of prior art image fixing apparatus including rollers are described in U.S. Pat. Nos. 3,293,059 to Stole, 3,566,076 to Fantuzzo and 4,568,949 to Muranaka. These existing fusing rollers typically apply an extremely high loading force along the line of contact between fusing rollers, e.g., 100 lbs. per lineal inch. In this case, for a ten inch long roller, 1,000 lbs. of force must be applied. Consequently, the structural support for such fusing rollers is typically relatively heavy and bulky in order to withstand extremely high forces.

Although a number of printers and printer drive mechanisms are known, a need exists for an improved ink jet printer which is capable of overcoming these and other disadvantages of the prior art.

SUMMARY OF THE INVENTION

In accordance with one aspect of the invention, a compact ink jet printer is disclosed for printing drops of ink on a record medium transported along a media transportation path to the printer. The printer includes an elongate drum supported for rotation about a longitudinal axis, with the drum having an exterior media-supporting surface. The media supporting surface has a relatively high coefficient of friction, preferably at least about one. A drum drive mechanism is coupled to the drum for rotating the drum axis about its longitudinal drum. A contact roller is positioned against the drums exterior surface and, together with the exterior surface, defines a nip in the transportation path, with the record medium being carried on the drum and through the nip. The contact roller serves to apply a low retention force to hold the medium against the drum. A platen is positioned along the transportation path. The record medium passes over a surface of the platen as it travels to the drum. The platen is preferably a fixed platen and is positioned at a printing location to provide a backup for the medium during the ejection of ink drops from a print head onto the medium at such location.

Although any suitable drive mechanism may be used for rotating the printer drum, a preferred drive mechanism in accordance with the invention comprises a stepper motor having an output shaft rotatable in incremental steps in response to each step by the stepper motor. A first timing belt sprocket is mounted to the motor's output shaft. A second timing belt sprocket is coupled to the drum. A timing belt is coupled to plural teeth of the first and second timing belt sprockets for transferring incremental motion from the output shaft to the drum. One or more intermediate timing belt sprockets may be utilized in addition to the first and second drive sprockets together with plural timing belts to accomplish the transfer of motion from the stepper motor to the drum. The use of timing belts virtually eliminates backlash that results from the use of plural drive gears in a drum driving mechanism. In addition, a timing belt or belts simultaneously engage multiple sprocket teeth, typically at least seven or eight or more teeth on smaller drive sprockets and many more on larger sprockets. Therefore, deviations in individual teeth are averaged and the error from such deviations is substantially suppressed. Also, an idler pulley or pulleys (not shown) may be used to urge the timing belt into contact with a greater number of sprocket teeth on the sprockets, and in particular smaller sprockets, to increase this averaging effect. Furthermore, as another aspect of the invention, the diameter of the drum, the distance through which the output shaft is incremented with each step of the stepper motor, and the ratio of the teeth on the sprockets may be selected such that the surface of the drum is rotated for a distance which is substantially equal to a multiple of the pixel height with each step of the stepper motor. In a preferred embodiment, each step of the stepper motor causes the rotation of the drum surface through a distance substantially equal to a single pixel height or an integral multiple thereof. Consequently, a simple, reliable, accurate and inexpensive drive mechanism is provided.

In addition, as another aspect of the invention, drum diameters of extremely small size can be used to further enhance the compactness of the printer. Typically, such drums are manufactured so as to be uniform in radius within a very tight tolerance. As a convenient manufacturing method, the drums may be coated with a material, such as urethane, and then ground or otherwise surfaced to achieve a drum diameter with the desired uniformity.

As yet another aspect of the present invention, a fusing roller may be supported for selective engagement with a record medium on the drum for fixing or spreading ink on the medium during printing. The fusing roller may be positioned in the medium's transportation path following the nip.

In accordance with another aspect of the present invention, the drum may include a clamp for clamping and holding an edge of the record medium as the medium is transported along the transportation path. An ink fusing roller may be supported for fusing or spreading ink drops while the record medium is on the drum. A suitable drive mechanism may be used to drive the drum through respective first and second revolutions during the printing of a sheet of the record medium. As the drum is rotated through the first revolution, ink is delivered to the medium and the fusing roller is disengaged from the drum. During rotation of the drum through a second revolution, the fusing roller is engaged with the medium on the drum to spread the ink drops deposited during the first revolution. As an optional feature of this embodiment of the invention, the clamp may be selectively retractable to a position within the drum and below the exterior drum surface so as to avoid engagement with the fusing roller during fusing of the record medium.

It is accordingly an overall object of the present invention to provide an improved ink jet printer and an improved drive mechanism for such printers.

These and other objects, features and advantages of the present invention will become apparent with reference to the following drawings and detailed description.

DETAILED DESCRIPTION OF PREFERRED EMBODIMENTS

Figure 1:
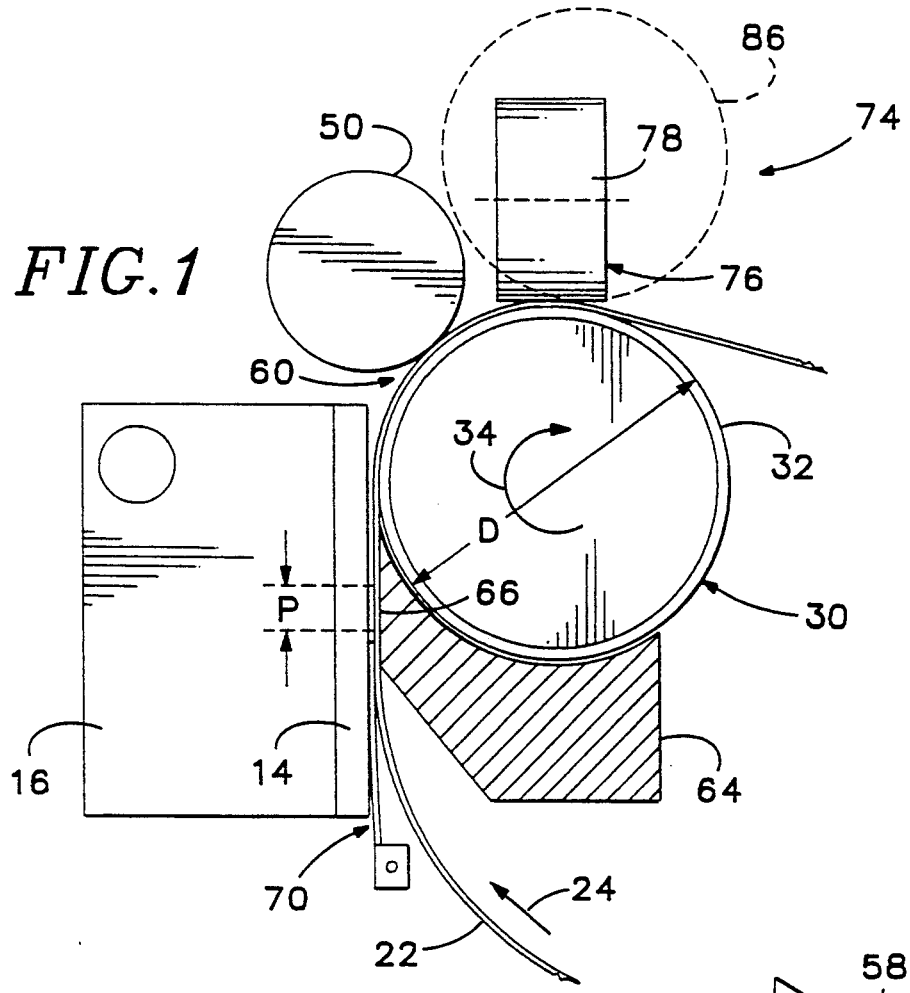
FIG. 1 is a side elevation of one form of a compact ink jet printer in accordance with the present invention.

Referring to FIG. 1, a printer has an ink jet print head 14 mounted to an ink containing reservoir system 16 that supplies ink to the print head. Print head 14 includes an ink drop ejection orifice, preferably plural orifices (not shown) from which ink drops are ejected toward an ink drop receiving record medium, such as indicated at 22 in FIG. 1. It should be noted that record medium 22 may be of paper or any other suitable material, and may be in continuous roll form or individual sheet form.

The record medium is transported through the printer along a transportation path in a first direction indicated by arrow 24.

Figure 2:
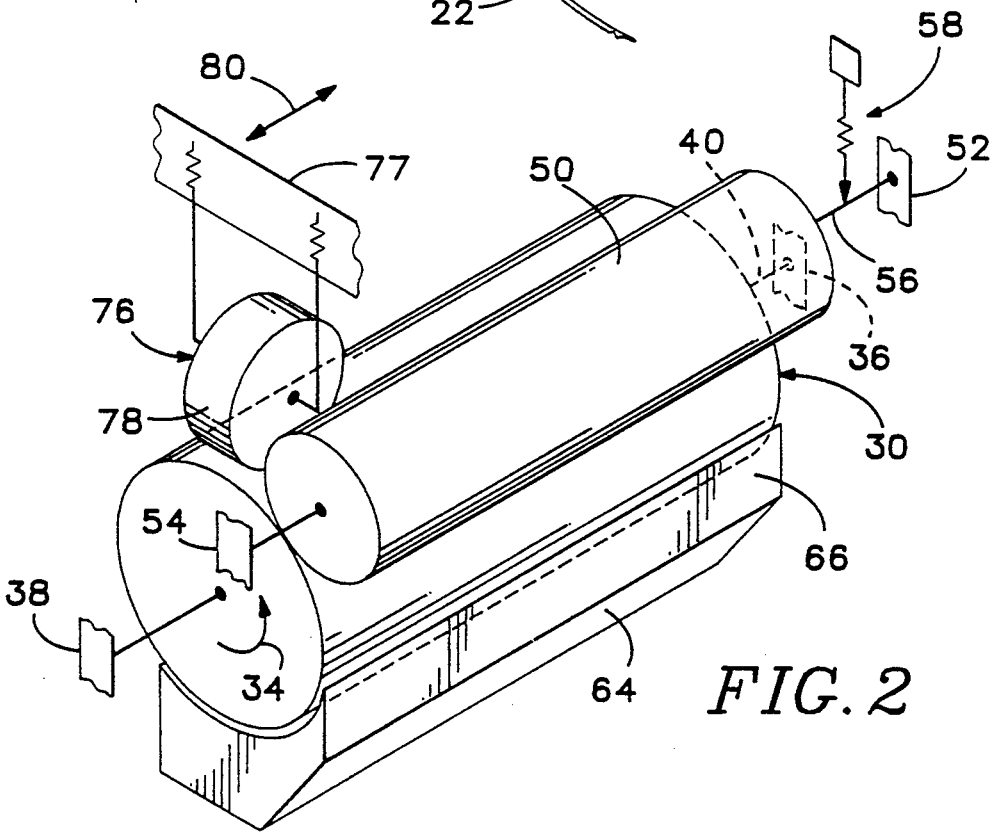
FIG. 2 is a perspective view of the printer of FIG. 1 with the ink jet print head and certain other components removed for clarity.

As shown in FIG. 1, a record medium supporting drum 30 having an exterior medium-supporting surface 32 is positioned such that a portion of the drum exterior surface is included in the transportationpath. For example, the portion of the drum which happens to be positioned between the eight o'clock and one o'clock positions in FIG. 1 at a given time is included in the illustrated transportation path. The drum 30 is driven by a drive mechanism, explained below, for rotation in a direction indicted by an arrow 34 so as to carry the medium along the transportation path. The illustrated drum 30 is typically of very compact size, for example, preferably no greater than about three inches in diameter, although it may be smaller or larger if desired for a particular application. As shown in FIG. 2, the drum 30 is elongate and has a longitudinal drum axis (not shown). The drum is supported for rotation by rigid drum supporting elements, such as portions 36, 38 of a frame of the printer. The drum typically includes a shaft 40, shown schematically in FIG. 2, which is journaled to the frame-supporting elements for rotation.

Referring to FIGS. 1 and 2, and elongate contact roller 50 is positioned as shown with a longitudinal axis generally parallel to the longitudinal axis of the drum 30, Like the drum 30, the contact roller 50 is typically journaled to rigid frame elements 52, 54, and may have a shaft 56 coupled to these frame elements. The respective ends of the shaft 56 are typically loaded with a weight of up to about two pounds (indicated schematically at 58 for one end of the shaft) with this load being adjustable if desired. As a result, the contact roller 50 is held against the drum 30 with a nip 60 being defined in the paper transportation path at the location where the contact roller 50 engages the drum 30. The record medium 22 is threaded through this nip 60 (see FIG. 1) and is retained against the drum by the contact roller.

The drum 30 may comprise, for example, a roller of a rigid material, such as stainless steel, and may either be solid or comprise a shell mounted to a shaft. To provide accurate printing, the radius of the drum is extremely uniform and is preferably within a tolerance of $+/-0.0005$ inches. In addition, the drum exterior surface 32 preferably has a relatively high coefficient of friction, with a most preferred surface having a coefficient of friction of at least about one. When manufactured in this manner, the drum together with the contact roller, carries the record medium along the transportation path as the drum is rotated without the medium slipping on the drum. One suitable approach for manufacturing the drum is to apply a film of a urethane or other high coefficient of friction material to the drum surface, and then grind or otherwise machine the surface to have a radius which is uniform to within the desired accuracy or tolerance. For example, it has been found that an initial coating of approximately 0.005 inches of urethane on a machined stainless steel roller can be finished to a drum with an exterior surface having an extremely uniform radius.

The ink jet printer of FIGS. 1 and 2 also has an elongate fixed platen indicated at 64. The platen 64 is typically rigidly mounted to the ink jet printer framework. The platen 64 has a flat backing surface 66 along which the print media 22 slides as it travels from the platen to the drum 30 and nip 60. A guide 70, such as a flat elongate biasing spring mounted to the printer framework, biases the record medium 22 against the backing surface 66. A portion of the backing surface 66, indicated at P in FIG. 1, may constitute a printing location at which ink from print head 14 is applied to the medium. For stability of the medium, and thermal consistency in the case of hot-melt ink, it is preferable that the record medium be backed up by a platen, such as fixed platen 64, as the ink is applied. By locating the nozzle orifices of print head 14 within the region P, platen 64 accomplishes this purpose. Alternatively, the drum 30 may perform this function. However, with a small drum, the record medium is curved as it wraps around the drum, which can interfere with the desired uniform printing.

In a conventional manner, print head 14, and the reservoir 16, if directly supporting the print head, may be mounted for shuttling or reciprocating motion across the surface of the record medium. This shuttling motion is typically in a direction skewed with respect to, and typically substantially orthogonal to, the direction of advancement of medium 22 by drum 24.

Print head 14 may take any form and may be of the drop-on-demand type, wherein droplets are only ejected in response to the state of energization of an associated transducer. Ink jet print head 14 may also be of the continuous type, and optionally may be provided with an air assist for accelerating the delivery of ink drops toward medium 22. A suitable print head is described in U.S. Pat. No. 4,727,378 to Le et al. Ink jet print heads of this type having an array of nozzle orifices may also be used. In the case of hot-melt (phase-change) ink, solidified ink is heated so as to be in a liquid state when ejected from the print head. Drops or spots of ink are thus applied to the record medium during printing. If the ink is of the hot-melt type, the ink spots undergo a liquid-to-solid phase transition on the medium. Also, the dots project somewhat from the surface of the medium when solidified. Certain types of media, such as transparencies, are not significantly penetrated by the impinging ink drops. As a result, for such media, the drops tend to project a greater degree from the media than in the case of other types of more porous media, such as plain paper. In the subtractive primary system of ink jet printing, secondary colors (red, green and blue) are achieved by jetting drops of two primary colors overlapping or on top of one another. In the case of phase-change inks, this results in areas being covered with different thicknesses of ink. This area of the medium should be contrasted with areas of the medium having a single layer of ink.

When hot-melt ink is utilized, advantages can be achieved by fixing or fusing the ink on the record medium. In general, this involves applying sufficient pressure to the deposited ink drops to spread the ink drops even in cases where ink layers are present in different thicknesses.

In FIG. 1, as the ink containing record medium 22 emerges from the nip 60 and travels in the direction of arrow 24, the medium passes to a pressure fusing or fixing mechanism indicated generally at 74. Mechanism 74, if utilized, is designed to apply pressure to ink deposits on the medium to flatten and spread them. In one exemplary form of a pressure application mechanism, shown in FIGS. 1 and 2, a support 77 is provided for rotatively carrying or mounting a pressure wheel 76. The support positions the wheel 76 with an external pressure application surface 78 of the wheel 76 pressed against the record medium so as to engage deposits of ink on the medium. As indicated schematically in FIG.

2, the support 76 is typically reciprocated as indicated by arrows 80 so as to move the pressure wheel 76 in a generally transverse direction from side-to-side of the medium. Thus, pressure wheel 76 makes repeated passes across the media. The pressure wheel is typically sized to make plural overlapping passes over each section of the medium, with from two to four passes being typically made depending in part upon the rate the medium is moved relative to the print head to expose unprinted media for printing. In FIGS. 1, a record medium support, in this case the drum 30, backs up the medium at the location where pressure wheel 76 engages the medium. The pressure wheel may also, for example, engage the record medium after the medium has left the surface of the drum 30 and while it is backed up by a surface other than the drum surface.

Pressure wheel 76 is typically quite small. For example, the wheel may have a diameter of less than three inches and typically less than one inch. In addition, the width of the wheel, and thus of the pressure application surface 78, is typically less than one inch, and preferably less than one-half inch, with one-quarter inch being a specific preferred example. The pressure wheel may be of any suitable material, but is typically of a rigid material such as stainless steel, or a plastic material of the type sold as Delrin by E.I. DuPont. The pressure wheel is typically loaded to provide a high fusing pressure, e.g., 100 pounds per lineal inch, along the line of engagement between the wheel and record medium. With a pressure wheel 0.25 inches wide, the length of the line of contact between the wheel and the record medium is correspondingly 0.25 inches. In this case, a loading force of 25 pounds would result in a desired line loading of 100 pounds per linear inch. Due to the relatively low loading force required to achieve the desired line loading, simplified and lighter weight supports 77 may be used to support the pressure applicator.

This type of pressure applicator is described in U.S. Patent application Ser. No. 07,577,382 to James D. Rise, filed on Sep. 4, 1990, entitled "Pressure Fixing and Developing Apparatus" and incorporated herein in its entirety by reference. Alternatively, as indicated in dashed lines at 86 in FIG. 1, an elongate pressure applying roller 86 may be utilized. In this case, the roller 86 has a longitudinal axis which is typically generally parallel to the axis of the drum 34. Also, like the wheel 76, the pressure fixing roller 86 may be backed up by a surface other than the drum 30. However, a more compact construction of an ink jet printer is achieved if the drum 30 is used as the back-up surface for either of the illustrated fusing devices.

Any suitable drive mechanism may be used for rotating drum 30. For example, a motor may be connected directly to drum shaft 40. Also, if an elongate fusing roller 86 is used, with the drum serving as the back up for this roller during fusing, a single drive mechanism for rotating the drum also rotates fusing roller 86 due to its contact with the drum. That is, in such a case, the drum in effect drives the fusing roller. Although these alternatives may be used, a preferred drive mechanism will next be described in connection with FIGS. 3-7.

Figure 3:
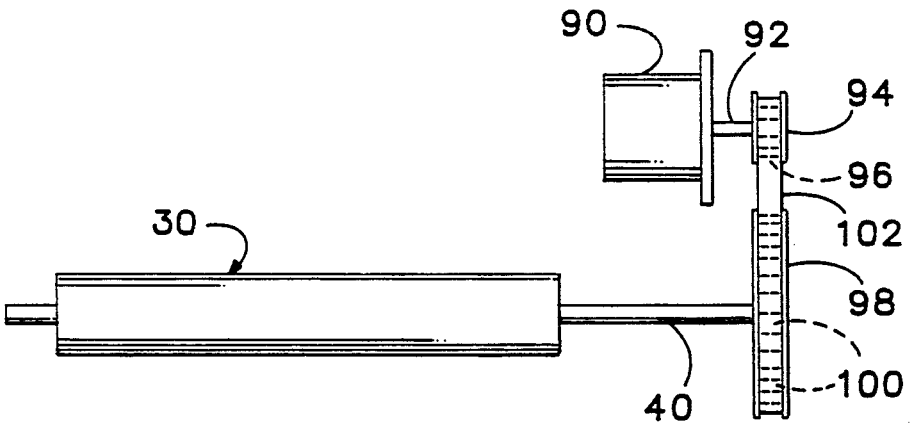
FIGS. 3, 4 and 5 illustrate preferred forms of drive mechanisms utilizing a stepper motor, timing belt or belts and timing belt sprockets for rotating the drum of an ink jet printer.
Figure 4:
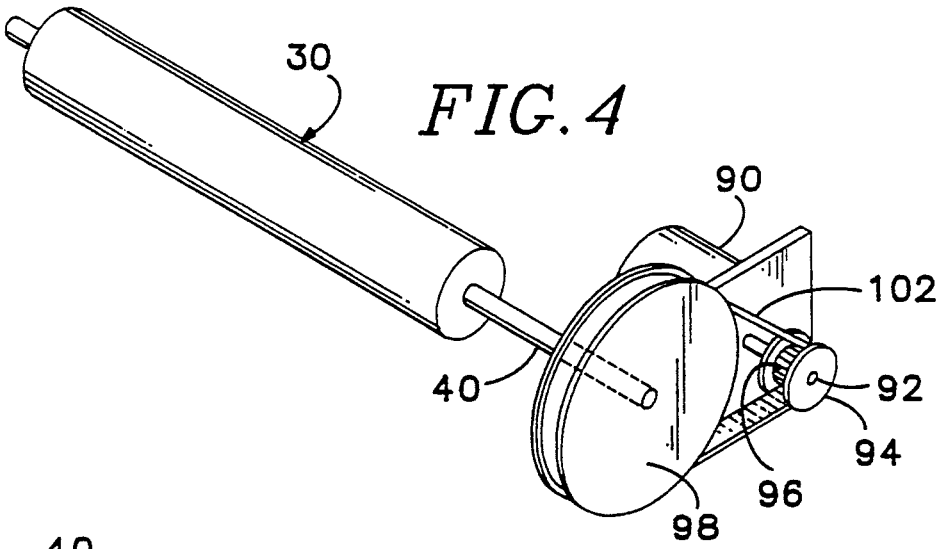

In particular, it has been surprisingly determined that inexpensive components may be utilized to achieve extremely precise motion of the drum 30 and record medium carried thereon. With reference to FIGS. 3 and 4, the illustrated drive mechanism includes a conventional stepper motor 90 having an output shaft 92 which is rotated through an incremental angle with each drive pulse applied to the stepper motor. A stepper motor of this type is designed to have its output shaft incremented by a predetermined number of steps for each complete revolution of the output shaft. As a specific example, the output shaft of a 200 step per revolution stepper motor would travel through an angle of 1.8 degrees for each step. By selecting a commercially available stepper motor having a noncumulative error factor design within prescribed limits, such as a five percent noncumulative error, the stepper motor will be within the prescribed error of 1.8 degrees of its theoretical position at the end of any number of steps. One suitable stepper motor is a P8266 series motor available from Oriental Motors Co., Ltd. of Japan at a current unit price of less than $20.00.

A first timing belt sprocket 94 is fixedly mounted to output shaft 92. The timing belt sprocket 94 includes plural teeth, as indicated by dashed lines 96 in FIG. 3 for certain of the teeth. The FIGS. 3 and 4 form of this drive mechanism also include a second timing belt sprocket 98 coupled to the drum 30, such as by being rigidly mounted to the drive shaft 40 of the drum. The timing belt sprocket 98 also includes plural teeth, some being indicated by the number 100 and dashed lines in FIG. 3. A timing belt means, such as a timing belt 102, is coupled to timing belt sprockets 94, 98 for transferring incremental motion from output shaft 92 to drum 30. One specific example of a suitable timing belt is a commercially available belt made by Chemi-flex of Lombard, Ill., and is of urethane with an aramid core. Timing belts are easy to tighten and virtually eliminate backlash.

Figure 6:
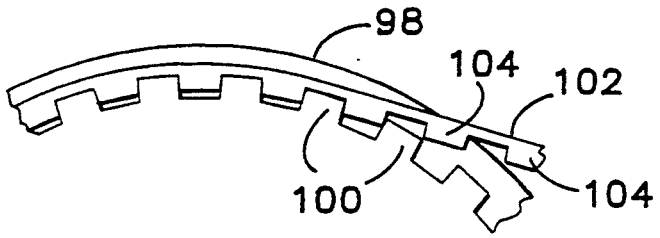
FIG. 6 is side elevation view illustrating the averaging accomplished utilizing a timing belt in a drive mechanism in accordance with FIGS. 3–5.

As shown in FIG. 6, timing belt 102 has plural teeth, some being indicated at 104, which nest between the teeth, for example the teeth 100 of timing belt sprocket 98, to positively engage the timing belt to the timing belt sprocket. Because timing belt 102 typically engages at least seven or eight teeth of each of the timing belt sprockets, tooth averaging is achieved. That is, any inaccuracies in the individual teeth of the timing belt sprockets are in effect averaged because the timing belt engages multiple teeth simultaneously. In addition, backlash, which is common in gear drive mechanisms, is substantially eliminated. Also, because of the ratios of teeth between the sprocket 98 and sprocket 94, with the sprocket 98 typically having many more teeth than the sprocket 94, a substantial reduction in the inertia of the drum is reflected onto the output shaft 92, thereby minimizing the loading, wear and potential slipping of this output shaft and providing an improved inertia matching of motor to load.

For example, with 180 teeth on the timing belt sprocket 98 and 30 teeth on the timing belt sprocket 94 a six to one reduction is achieved.

Figure 5:
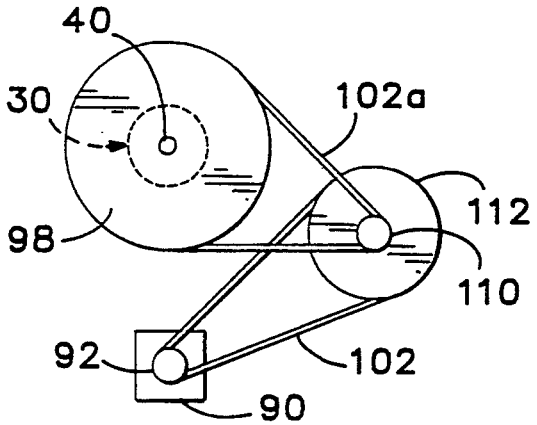

As shown in FIG. 5, one or more intermediate timing belt sprockets may be utilized, such as indicated by sprockets 110 and 112. In this case, plural timing belts 102 and 102A are also used. Although the introduction of intermediate timing belt sprockets 110, 112 adds to the size of the drive mechanism, further reductions in the inertia reflected from the drum to the output shaft 92 of stepper motor 90 may be achieved. In one specific example, a 30:1 drive ratio is achieved using this double reduction approach. That is, the sprocket 94 may have 32 teeth, the sprocket 110 may have 160 teeth, the sprocket 112 may have 30 teeth and the sprocket 98 may have 180 teeth. In this specific case, the drum would be larger to achieve a one pixel per stepper motor step relationship.

Figure 7:
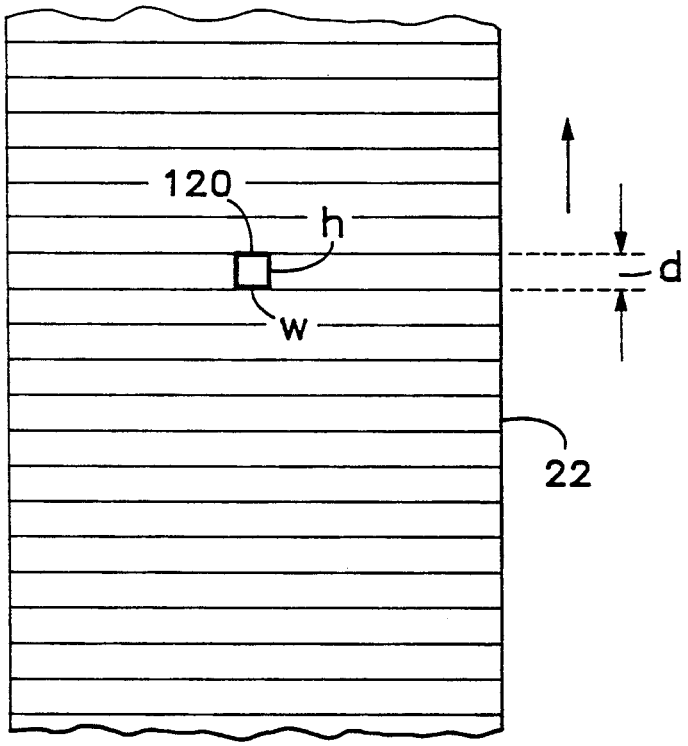
FIG. 7 is a schematic illustration of a pixel on a sheet of record medium which illustrates the relationship between the pixel height and distance d traveled in response to a step by a stepper motor used in the drive mechanism of FIGS. 3–5.

The circumference of drum 30 and the ratios of the teeth on the sprockets 98 and 94 (as well as on any intermediate sprockets, if used), together with the distance through which the output shaft is incremented with each step of the stepper motor, may be selected such that the exterior surface of the drum is rotated through a distance that is substantially equal to a multiple of the pixel height with each step of the stepper motor. That is, as shown in FIG. 7, printers typically print in lines having picture elements (pixels) 120 having a predetermined height (h) and predetermined width (w). By selecting components of the drive mechanisms to advance the print media 22 a distance d which equals the height of a pixel or a multiple of this distance, and preferably an integral multiple of this distance, it has been found that banding of the printed image on the printed medium is substantially eliminated. Banding refers to a phenomenon whereby the ink drops deposited by a print head are not uniformly applied, so that undesired overlapping or underlapping of ink occurs in printed lines, causing a banding or nonuniform appearance of the printed image. By accurately advancing the record medium to a multiple of a pixel height, as the print head makes successive passes across the record medium, banding is virtually undetectable to the human eye. Typically, an ink jet print head deposits multiple lines of ink in one pass; thus, when a particular group of lines is printed, the record medium is advanced a sufficient number of pixels to move an unprinted area of the medium into position for printing.

As a specific example, assume it is desired to advance the record medium one pixel height for each step of the stepper motor. Also assume that the timing belt sprocket 94 has 30 teeth, while the timing belt sprocket 98 has 180 teeth. Furthermore, assume a stepper motor is used that steps through 1.8 degrees per step, which translates to two hundred steps per revolution. Also assume that the desired pixel height is 0.003333 inches.

With these variables in mind, the drum diameter may be selected such that the distance d traveled by the drum surface and thus the record medium in response to one step of the stepper motor is equal to the pixel height. Specifically, the drum diameter D would be given by the following formula:

$$D = (\textit{Drive Ratio of Timing Belt Sprockets})(\textit{No. of Steps per Revolution})(\textit{Pixel Height})$$

For this specific case, this means that $D = [(6)(200)(0.003333)]/\pi = 1.273$ inches.

Generally, if the drum diameter and number of steps per revolution is fixed, the drive ratio of the timing belt sprockets may be adjusted to achieve this result. Similarly, if more than one pixel height is to be traversed with each step of the stepper motor, the diameter D is divided by the number of pixel heights to be travelled with each step.

With a five percent noncumulative error stepper motor, in a one step per pixel device, with pixels 0.003333 inch high and where the printer is printing at 300 drops per inch, in theory the print media would also be within one twentieth of a pixel of its computed location. However, in practice, the record medium has been found to be within approximately one-tenth of a pixel of its theoretical location. With a more accurate stepper motor than a five percent noncumulative error motor, even greater accuracies in record medium advancement can be achieved. In other words, for this application involving pixels of 0.003333 inch high and a five percent noncumulative error stepper motor, the record medium has been found to be within 0.0003 inch of its expected position (worst case) and typically within 0.0001 inch (about three percent) of the expected position. If the ratio is two pixels per step of the stepper motor, the expected typical accuracy would be within 0.0002 inch or about six percent (worst case would be expected to be about 0.00067 inch). If the ratio is three pixels per step of the stepper motor, the expected typical accuracy would be 0.0003 inch or about ten percent (worst case expected to be about 0.001 inch). Any lesser typical accuracy than about ten percent would be unacceptable for rapid high resolution ink jet printing due to banding. Therefore the phrase substantially equal to a multiple of a pixel height in this description means a typical accuracy of within about ten percent of the pixel height times the multiplier. With stepper motors of greater accuracies, higher ratios of pixel heights per step may be achieved and still fall within this substantially equal to a pixel height definition. This highly accurate positioning of the print media virtually eliminates the banding problem and utilizes an inexpensive drive mechanism to achieve this result.

Figure 8:
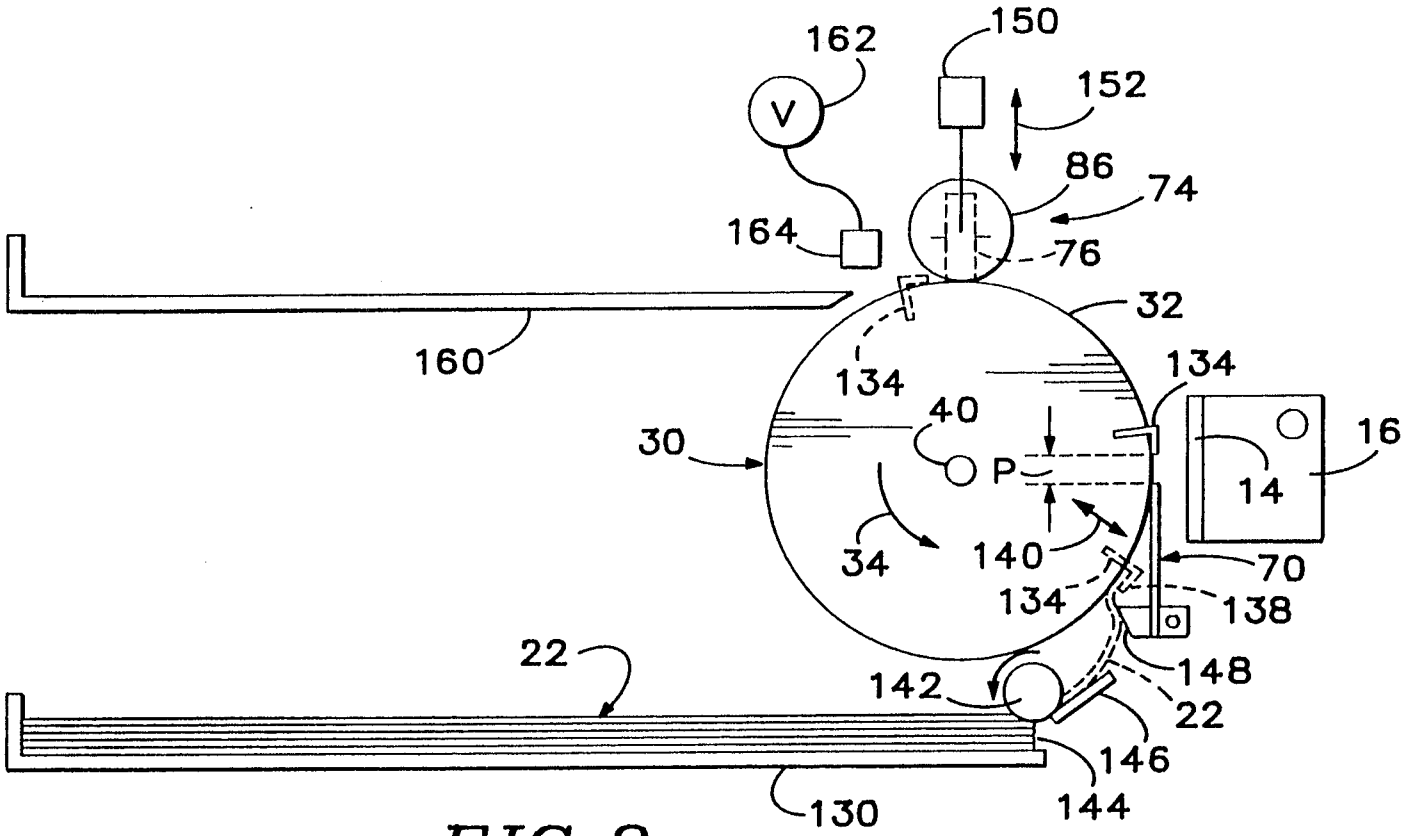
FIG. 8 is an alternative embodiment of a compact ink jet printer in accordance with the present invention utilizing a clamp for holding a sheet of record medium onto a drum.

With reference to FIG. 8, an alternative embodiment of invention will be described. For convenience, elements in common in the FIG. 8 embodiment with those of the embodiment of FIGS. 1 and 2 have been assigned the same numbers and will not be discussed in detail. In addition, any suitable drive mechanism may be used for the ink jet printer of FIG. 8, preferably such as previously described.

In the FIG. 8 embodiment, sheets of record medium 22 of a predetermined length are placed in an input or load tray 130. Assuming it is desired to print a sheet of the medium, a feed mechanism delivers the sheet to the drum 30. More specifically, one edge of the sheet, such as the leading edge for purposes this description, is delivered to a clamp 134. At this time, the clamp 134 is in an open position with a clamping arm 138 spaced from the drum exterior surface 32 such that the leading edge of the sheet fits between the drum and the clamping arm. The clamping arm is movable in the direction indicated by arrow 140, and when retracted toward the drum exterior surface, engages the received free end of the sheet and clamps the sheet to the drum. The clamp 134 may be any one of a wide variety of commercially available drum mounted sheet clamping mechanisms. The specifically illustrated sheet feed mechanism, which may take other forms, comprises a scuff roller 142, which is rotated in a direction 144 to pick up a sheet of the record medium. The medium is guided by guides 146 and 148 into the open clamp. Typically the record medium is buckled as it is delivered to clamp 134 so that its leading edge is positioned against the clamp along its entire length.

Figure 9:
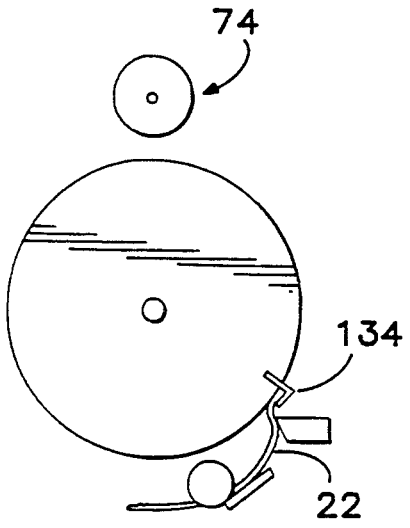
FIGS. 9–12 illustrate the operation of the ink jet printer of FIG. 8 during loading, printing, fusing and ejecting a sheet of record medium during a printing cycle.
Figure 10:
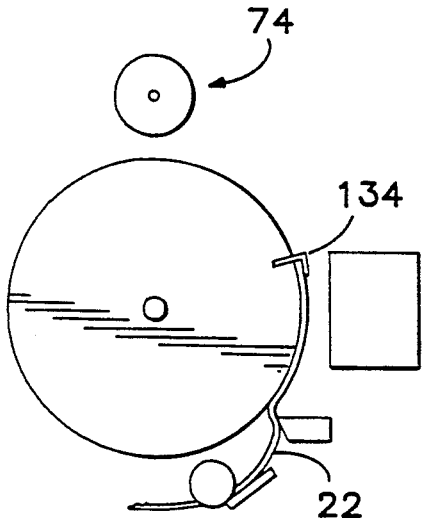

The sheet, now clamped in place on the drum, is carried with the rotation of the drum toward the printing location P. That is, when the clamp 134 is approximately at the three o'clock position shown in this FIG., the record medium is positioned for application of ink drops from the print head 14. Rotation of the drum 30 continues until the entire sheet has passed the printing location. These loading and printing steps are shown schematically in FIGS. 9 and 10.

It should be noted that the pressure fusing device 74 in this FIG. 8 embodiment is mounted to the printer frame or other rigid element 150 so as to be extendable into engagement with the drum exterior surface 32 and retractable from engagement with this surface as indicated by the arrow 152. The pressure fusing mechanism may be mounted on a pneumatic or hydraulic cylinder to accomplish this motion. During the revolution of the drum 30 during which printing occurs, the fusing apparatus is typically retracted from the drum. However, fusing may be accomplished immediately after the ink is applied, such as when the ink-bearing sheet reaches the twelve o'clock position, the location of the fusing apparatus, in FIG. 8. Retraction of the fusing mechanism during printing does, however, eliminate any potential interference of the fusing mechanism with the motion of the drum during printing. Also, when the fusing mechanism 74 is spaced from the drum exterior surface, the clamp arm 138, if not retracted beneath the surface of the drum, passes through the gap between the fusing mechanism and drum.

The circumference of the drum is sized to be approximately equal to, and is preferably typically no more than two inches greater than the maximum length of the sheets of record medium being printed by the printer. For a typical application, the drum diameter is less than four inches, so that the printer may be extremely compact.

Figure 11:
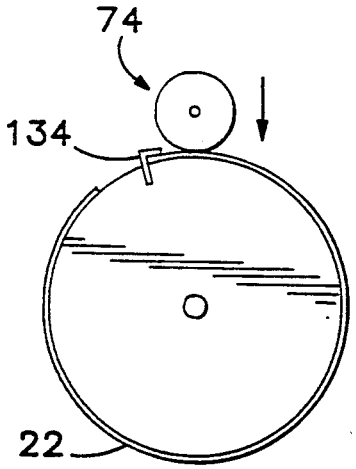
Figure 12:
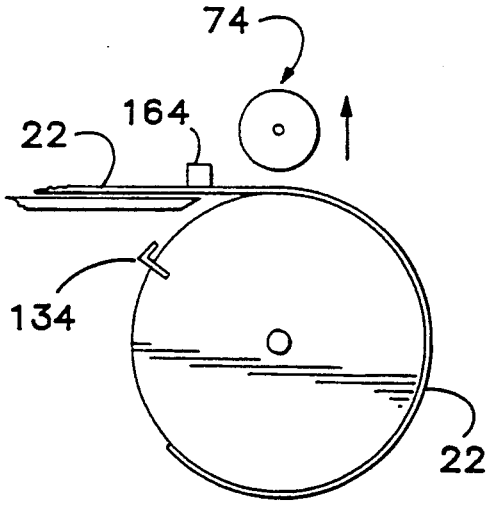

Following deposition of ink onto the record medium, and assuming a fusing mechanism, such as shown in FIG. 8 is used, the fusing mechanism is shifted against the medium on the drum exterior surface as indicated in FIG. 11. The drum is then rotated through a second revolution with the fusing mechanism flattening and spreading the ink deposits on the sheet. Thereafter, as shown in FIG. 12 (and also with reference to FIG. 8) the clamp 134 is opened and the printed sheet exits from the drum onto an output tray 160 positioned above the tray 130. A vacuum block 164 coupled to a vacuum 162 may be used to apply a vacuum to the record medium to lift it from the drum and guide the sheet onto the output tray 160 following the printing cycle.

Figure 13:
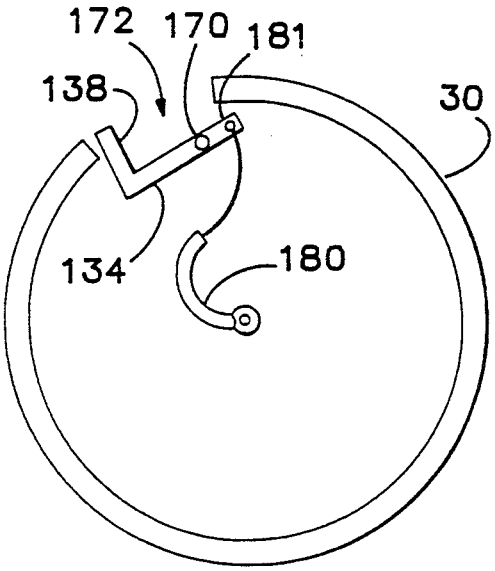
FIGS. 13–15 illustrate one form of retractable clamp optionally used in the embodiment of FIG. 8 for holding a sheet of record medium against a drum.
Figure 14:
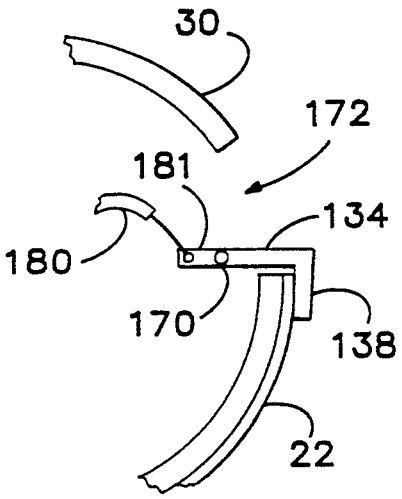
Figure 15:
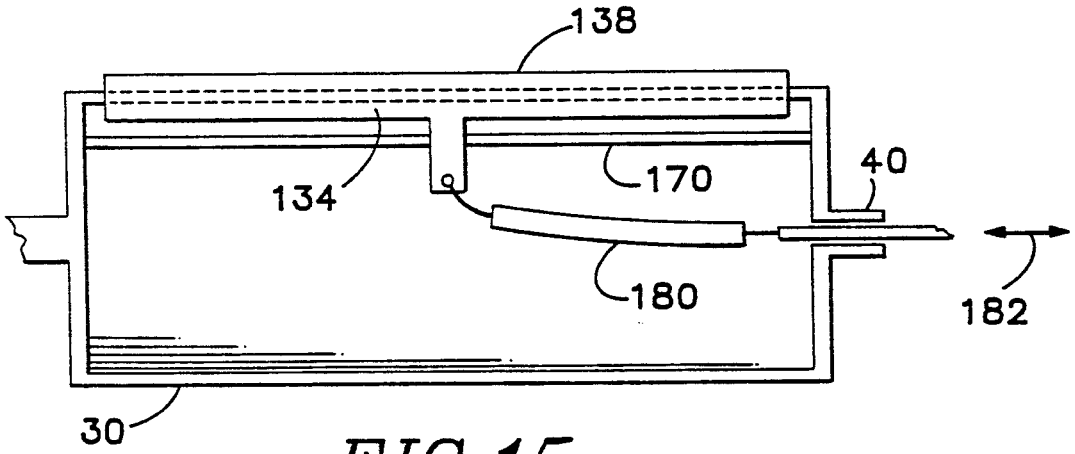

As shown in FIGS. 13–15, the clamp 134 may comprise an elongate clamping bar which is pivoted by a pivot 170 to the drum and which is operable to be retracted within a recess 172 provided in the drum exterior surface. For example, the clamp arm 138 may be retracted into the recess during the fusing portions of the printing operation such that the clamp does not interfere with the fusing mechanism 74. Shown schematically in FIGS. 13–15, a push-pull flex cable 180 has one end coupled to a lever portion 181 of the clamping mechanism 134. When the cable 180 is shifted in the respective directions indicated by arrow 182, the clamp is pivoted between clamped and released positions as shown in FIGS. 13 and 14. Typically a solenoid is used to shift the cable assembly to open and close the clamp. Again, however, any suitable clamping mechanism may be utilized in the present invention.

Having illustrated and described the present invention with reference to several preferred embodiments, it should be apparent to those skilled in the art that my invention may be modified in arrangement and detail without departing from such principles. I claim as my invention all such embodiments as fall within the scope of the following claims.

I claim:

1. A compact ink jet printer for depositing drops of ink onto a record medium transported along a transportation path in a first direction through the printer, the printer comprising:

a drum support;

an elongate drum having a longitudinal drum axis and rotatably supported by the drum support for rotation about the longitudinal drum axis, the drum having an exterior record medium supporting surface;

a drum drive mechanism coupled to the drum for rotating the drum about the longitudinal drum axis, and comprising a stepper motor having an output shaft rotatable in an incremental step in response to each step by the stepper motor, a first timing belt sprocket mounted to the output shaft, the first timing belt sprocket having plural gear teeth and rotating with the rotation of the output shaft, a second timing belt sprocket coupled to the drum, the second timing belt sprocket having plural gear teeth, and timing belt means coupled to said first and second timing belt sprockets for transferring incremental motion from the output shaft to the drum, the record medium being printed in pixels having a predetermined height corresponding to a predetermined distance of travel along the transportation path, and in which the diameter of the drum, a distance through which the output shaft is incremented with each step of the stepper motor, and a ratio of the gear teeth on said first and second timing belt sprockets is selected such that the exterior surface of the drum is rotated through a distance substantially equal to a multiple of the pixel height with each step of the stepper motor;

a contact roller positioned against the drum exterior surface and together with the drum exterior surface defining a nip in the transportation path with the record medium being carried by the drum through the nip;

a platen along he transportation path at a printing location that is prior to the nip such that a record medium traveling in the first direction reaches the platen prior to the nip; and an ink jet print head positioned to project ink drops onto the record medium at the printing location.

2. A compact printer according to claim 1 in which the multiple is one.

3. A compact printer according to claim 1 including at least one intermediate timing belt sprocket with plural gear teeth in addition to said first and second timing belt sprockets, the timing belt means comprising means for coupling the first timing belt sprocket and the at least one intermediate timing belt sprocket together and to the said second timing belt sprocket, the record medium being printed in pixels having a predetermined height corresponding to a predetermined distance of travel along the transportation path, and in which the diameter of the drum, the distance through which the output shaft is incremented with each step of the stepper motor, and the ratio of a gear teeth on the first, intermediate and second timing belt sprockets are selected such that a surface of the drum is rotated through a distance substantially equal to a multiple of the pixel height with each step of the stepper motor.

4. A compact printer according to claim 3 in which the multiple is one.

5. A compact ink jet printer for depositing drops of ink onto a record medium transported along a transportation path in a first direction through the printer, the printer comprising: a drum support;

an elongate drum having a longitudinal drum axis and rotatably supported by the drum support for rotation about the longitudinal drum axis, the drum having an exterior record medium supporting surface, the supporting surface having a coefficient of friction of at least one;

a drum drive mechanism coupled to the drum for rotating the drum about the longitudinal drum axis through first and second revolutions;

a contact roller positioned against the drum exterior surface and together with the drum exterior surface defining a nip in the transportation path with the record medium being carried by the drum through the nip;

a platen along the transportation path at a printing location that is prior to the nip such that a record medium traveling in the first direction reaches the platen prior to the nip;

an ink jet print head positioned to project ink drops onto the record medium at the printing location during rotation of the drum through the first revolution; and a fusing roller positioned along the record medium transportation path at an ink fusing location which is after the nip such that record medium traveling in the first direction reaches the fusing roller following the nip, the fusing roller comprising means for applying pressure selectively against the drum exterior surface and thereby to a record medium passing between the fusing roller and drum exterior surface to fuse ink onto a surface of the medium during rotation of the drum through the second revolution, the fusing roller being disengageable from the drum during rotation of the drum through the second revolution.

6. In an ink jet printer for printing drops of ink on a record medium, the printer having a transportation path along which record medium travels through the printer, an elongate drum included in the transportation path, the drum being rotatable about a longitudinal axis so as to carry a record medium on a surface of the drum along a portion of the transportation path, the record medium thereby being printed in pixels having a predetermined height corresponding to a predetermined distance of travel along the transportation path, a drive mechanism for rotating the drum comprising:

a stepper motor having an output shaft rotatable in an incremental step in response to each step by the stepper motor;

a first timing belt sprocket mounted to the output shaft, the first timing belt sprocket having plural gear teeth and rotating with the rotation of the output shaft;

a second timing belt sprocket coupled to the drum, the second timing belt sprocket having plural gear teeth; and timing belt means coupled to said first and second timing belt sprockets for transferring incremental motion from the output shaft to the drum; and the diameter of the drum, a distance through which the output shaft is incremented with each step of the stepper motor, and a ratio of the gear teeth on said first and second timing belt sprockets is selected such that the surface of the drum is rotated through a distance substantially equal to a multiple of the pixel height with each step of the stepper motor.

7. In an ink jet printer, a drive mechanism according to claim 6 in which the multiple is one.

8. In an ink jet printer, a drive mechanism according to claim 6 including at least one intermediate timing belt sprocket with plural gear teeth in addition to the first and second timing belt sprockets, the timing belt means comprising means for coupling the first timing belt sprocket and said at least one intermediate timing belt sprocket together and to the second timing belt sprocket; and in which the diameter of the drum, a distance through which the output shaft is incremented with each step or the stepper motor, and a ratio of the gear teeth on the first, intermediate and second timing belt sprockets is selected such that the surface of the drum is rotated through a distance substantially equal to a multiple of the pixel height with each step of the stepper motor.

9. In an ink jet printer, a drive mechanism according to claim 8 in which the multiple is one.

10. A compact ink jet printer for printing ink on sheets of a record medium, the sheets having first and second edges and opposed side edges, the printer comprising:

a drum having a longitudinal drum axis and an exterior drum surface;

drive means for rotating the drum in a first direction;

a clamp on the drum positioned to receive a first edge of a sheet of a record medium and operable to selectively clamp and release the first edge to and from the exterior drum surface;

a record medium sheet feeder that delivers the first edge of the sheet to the clamp, whereby the record medium may be clamped by the clamp to the drum and carried by the drum in the first direction through a printing location;

an ink jet printer head for delivering ink to the record medium as the record medium is carried through the printing location;

an ink fusing roller;

a fusing roller support for supporting the fusing roller for selective engagement with the record medium on the exterior drum surface to apply pressure to the record medium and fuse ink on the record medium while the record medium is on the drum; and the drive means comprising means for driving the drum through first and second revolutions during printing of a sheet of a record medium during rotation of the drum through the first revolution, the ink jet print head being operable to deliver ink to the record medium while the fusing roller is disengaged from the drum, and during rotation of the drum through the second revolution the fusing roller being engaged with the record medium carried by the drum.

11. A compact ink jet printer according to claim 10 in which the circumference of the drum is no less than the maximum length of the sheet of a record medium being printed by the printer, such that an entire sheet may be clamped to the exterior drum surface without the first and second edges overlapping, the circumference of the drum being no more than about two inches greater than the maximum length of a sheet of the record medium being printed by the printer.

12. A compact ink jet printer according to claim 10 in which the fusing roller comprises an elongate fusing roller having a longitudinal axis which is generally parallel to the axis of the drum.

13. A compact ink jet printer according to claim 10 in which the clamp is selectively retractable to a position below the exterior drum surface so as to avoid engagement with the fusing roller during fusing of the record medium after printing.

14. A compact printer according to claim 10 in which the drive means comprises a stepper motor having an output shaft rotatable in an incremental step in response to each step by the stepper motor, a first timing belt sprocket mounted to the output shaft, the first timing belt sprocket having plural gear teeth and rotating with the rotation of the output shaft, a second timing belt sprocket mounted to the drum, the second timing belt sprocket having plural gear teeth, and timing belt means coupled to said first and second timing belt sprockets for transferring incremental motion from the output shaft to the drum, the record medium being printed in pixels having a predetermined height corresponding to a predetermined distance of travel of the medium, and in which the diameter of the drum, the distance through which a output shaft is incremented with each step of the stepper motor, and a ratio of the gear teeth on the first and second timing belt sprocket is selected such that the exterior drum surface is rotated through a distance substantially equal to a multiple of the pixel height with each step of the stepper motor.

15. A compact printer according to claim 14 in which the drive means includes at least one intermediate timing belt sprocket with plural gear teeth in addition to the first and second timing belt sprockets, the timing belt means comprising means for coupling the first timing belt sprocket and said at least one intermediate timing belt sprocket together and to the second timing belt sprocket, the record medium being printed in pixels having a predetermined height corresponding to a predetermined distance of travel of the record medium, and in which the diameter of the drum, a distance through which the output shaft is incremented with each step of the stepper motor, and a ratio of the gear teeth on the first, intermediate and second timing belt sprocket is selected such that the exterior drum surface is rotated through a distance substantially equal to a multiple of the pixel height with each step of the stepper motor.

16. A compact ink jet printer according to claim 10 in which the fusing roller comprises a wheel that travels reciproctingly relative to the drum surface along a path parallel to the longitudinal drum axis.

* * * * *

UNITED STATES PATENT AND TRADEMARK OFFICE

CERTIFICATE OF CORRECTION

PATENT NO. : 5,121,139

DATED : June 9, 1992

INVENTOR(S) : Edward F. Burke

It is certified that error appears in the above-identified patent and that said Letters Patent is hereby corrected as shown below:

Col. 12, line 40, "he" should be "the".

Col. 12, line 62, "a surface" should be "the surface".

Col. 13, line 62, "and" should be "wherein".

Col. 14, line 39, "printer" should be "print".

Col. 14, line 60, "the sheet of a record" should be "a sheet of the record".

Col. 16, line 17, "sprocket" should be "sprockets".

Signed and Sealed this

Thirty-first Day of August, 1993

*Attest:*

Bruce Lehman

BRUCE LEHMAN

*Attesting Officer*

*Commissioner of Patents and Trademarks*